US011596287B2

(12) United States Patent
Brown

(10) Patent No.: US 11,596,287 B2
(45) Date of Patent: Mar. 7, 2023

(54) LIQUID OR GEL APPLICATOR

(71) Applicant: Jarred Schade Brown, Denver, CO (US)

(72) Inventor: Jarred Schade Brown, Denver, CO (US)

( * ) Notice: Subject to any disclaimer, the term of this patent is extended or adjusted under 35 U.S.C. 154(b) by 123 days.

(21) Appl. No.: 16/627,573

(22) PCT Filed: Jun. 29, 2018

(86) PCT No.: PCT/US2018/040259
§ 371 (c)(1),
(2) Date: Dec. 30, 2019

(87) PCT Pub. No.: WO2019/006281
PCT Pub. Date: Jan. 3, 2019

(65) Prior Publication Data

US 2020/0222937 A1 Jul. 16, 2020

Related U.S. Application Data

(60) Provisional application No. 62/527,812, filed on Jun. 30, 2017.

(51) Int. Cl.
*B05C 17/10* (2006.01)
*A47L 13/17* (2006.01)

(52) U.S. Cl.
CPC ..... *A47L 13/17* (2013.01); *B05C 17/10* (2013.01)

(58) Field of Classification Search
USPC ..... 118/264; 15/104.94, 227; 401/7
See application file for complete search history.

(56) References Cited

U.S. PATENT DOCUMENTS 6,811,338 B1 * 11/2004 Manske, Jr. ..... A45D 40/00 401/7
2014/0259494 A1 * 9/2014 Bober ..... B32B 3/04 15/228

* cited by examiner

*Primary Examiner* — Yewebdar T Tadesse
(74) *Attorney, Agent, or Firm* — FisherBroyles, LLP; Thomas J. Osborne, Jr.

(57) ABSTRACT

An applicator for applying liquid and gel stains, lacquers, shellac, or other sealers to wood by hand. In various embodiments, the applicator comprises various layers including an outer applicator layer, an inner reservoir layer, and, in some embodiments, a semi-permeable middle layer. The middle layer may act as a barrier of variable permeability and/or provide varying levels of rigidity to the pad. In all cases the various layers are fastened to one another throughout the planar intersection so that the applicator sheet can be cut to provide applicators of diverse sizes without compromising the integrity of the construction.

14 Claims, 3 Drawing Sheets

LIQUID OR GEL APPLICATOR

CROSS-REFERENCE TO RELATED APPLICATIONS

This application claims the benefit of U.S. provisional application No. 62/527,812, filed 30 Jun. 2017, which is hereby incorporated by reference as though fully set forth herein.

FIELD

The present disclosure is related to applicators for applying liquid and gel stains, lacquers, shellac, or other sealers to wood by hand.

BACKGROUND

Applicators for applying liquid and gel stains, lacquers, shellac, or the like (herein referred to as "stains") to wood or other materials typically include rags, foam brushes, traditional bristle brushes, and terrycloth applicator pads. Each of these products have significant shortcomings in design. Rags are not good for inside corners and no matter how carefully they are folded, application pressure is uneven resulting in streaks, especially with the thickness of gel stains. They also tend to snag and often leave lint. Finally, due to the wadding, folding and saturation of stain, rags can become a fire hazard if not properly disposed. Foam brushes are inexpensive, disposable, present less fire hazard, provide even pressure and have a chisel end for corners but they easily snag and quickly rip and/or fall off the handle. Traditional brushes are expensive, hard to clean, and soak too much product up into the reservoir. This is fine for paint but difficult for expensive, thick, oil-based products like gel stains. And, all but the most expensive brushes tend to leave bristles and/or brush marks. The stain pads on the market at the time of this writing are too thick to get into corners, are made of terrycloth which easily snags and leaves lint in the finish. They are too big to get into the small cans of stain and since they are constructed of terry cloth sewn around foam, you cannot cut them to a desired size.

SUMMARY

Stain applicators are provided that eliminate the shortcomings of rags, foam brushes, traditional bristle brushes, and terrycloth applicator pads to provide an economical, disposable applicator that can be cut-to-size, provides a streak free finish, without snagging or leaving lint in the finish. Additionally, due to its design it greatly reduces the likelihood of spontaneous combustion.

In various embodiments, applicators are provided that relate to application of stains to wood or other materials. In one embodiment for example, a disposable applicator is provided that will not snag on wood fibers, and can be cut to various sizes. The applicator may be double or single sided and of various thicknesses. In various embodiments, it can be made of an outer application layer adapted to provide for smooth application of stain, a reservoir layer made of permeable materials, such as of various but consistent porosities adapted to provide temporary storage of stains of various viscosities. Some embodiments may include a thin, impermeable, or semi-permeable, membrane that separates and adjoins the two reservoirs. Some example embodiments illustrate a rectangular applicator with various edge designs (for example, rounded and wedge, convex and concave) but other applicator and edge shapes are contemplated. In some embodiments, the applicator is constructed in such a way that it is not susceptible to solvents and may be cut to diverse sizes without compromising the integrity of the construction.

In some embodiments of an applicator for applying liquid and gel stains, lacquers, sealers, and the like, to wood surfaces, the applicator comprises three basic components; an outer application layer that provides for smooth application of stain, a reservoir layer made of permeable materials of various but consistent porosities and various but consistent thicknesses that will provide temporary storage of stain of various viscosities. And in some embodiments, a thin membrane of various permeability and pliability, that separates and adjoins the two reservoirs. The layers are securely attached to one another throughout the planar intersections. The attachment, for example, may be by way of solvent resistant glue, sonic welding, or other contemplated methods so that the pad is resistant to solvents and can be cut to diverse sizes without compromising the integrity of the applicator.

While the above-identified drawings and figures set forth embodiments of the invention, other embodiments are also contemplated, as noted in the discussions. In all cases, this disclosure presents the invention by way of representation and not limitation. It should be understood that numerous other modifications and embodiments can be devised by those skilled in the art, which fall within the scope of this invention. An example, but not a limitation, is the use of differing outer materials, variations in type, porosity, permeability, density and thickness of inner reservoir layers creating various embodiments suitable for use with various applications.

DETAILED DESCRIPTION

Figure 1:
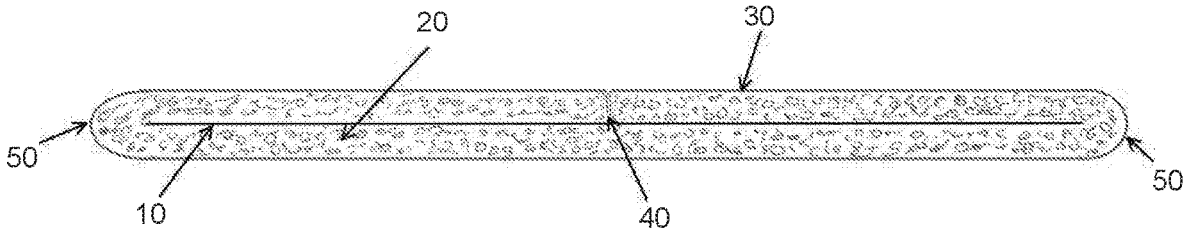
FIG. 1 is a side view of an embodiment of a stain pad.

FIG. 1 is a side view of the of an example embodiment of an applicator. In this particular embodiment, the applicator comprises three separate layers. In this embodiment, the innermost layer 10 is a flexible, waterproof membrane around which, the second reservoir layer 20 is folded and secured to first layer using solvent resistant glue, sonic welding or other contemplated methods. The second layer 20 is made of a porous, open cell material of consistent thickness which is folded in such a way that the seam 40 of the middle layer 20 and top layer 30 is a distance from edges/ends 50. By placing the seam a distance from the outer edges, it allows for both outer edges, 50, to be used in the application of stains. In the presented embodiment, the seam 40 is the point at which the second layer 20 and the outermost application layer 30 intersect. This intersection is currently contemplated as a simple butt joint but other options are also contemplated as a manner of manufacturing. The third and outer most layer 30 is made of a soft, permeable, loop-less, colorfast, non-shedding, non-fraying material which is attached to the second middle layer, such as by way of solvent resistant glue, sonic welding, or other contemplated methods such that, if cut, the outer layer 30 will remain adhered to the middle layer. Thus, in some embodiments, the outer layer 30 may be attached to the second layer 20 and/or the second layer 20 may be attached to the innermost layer 10 along substantially all or all of the adjacent surfaces to allow for the applicator to be cut into any desired shape or configuration, such as for specialty uses.

Figure 2:
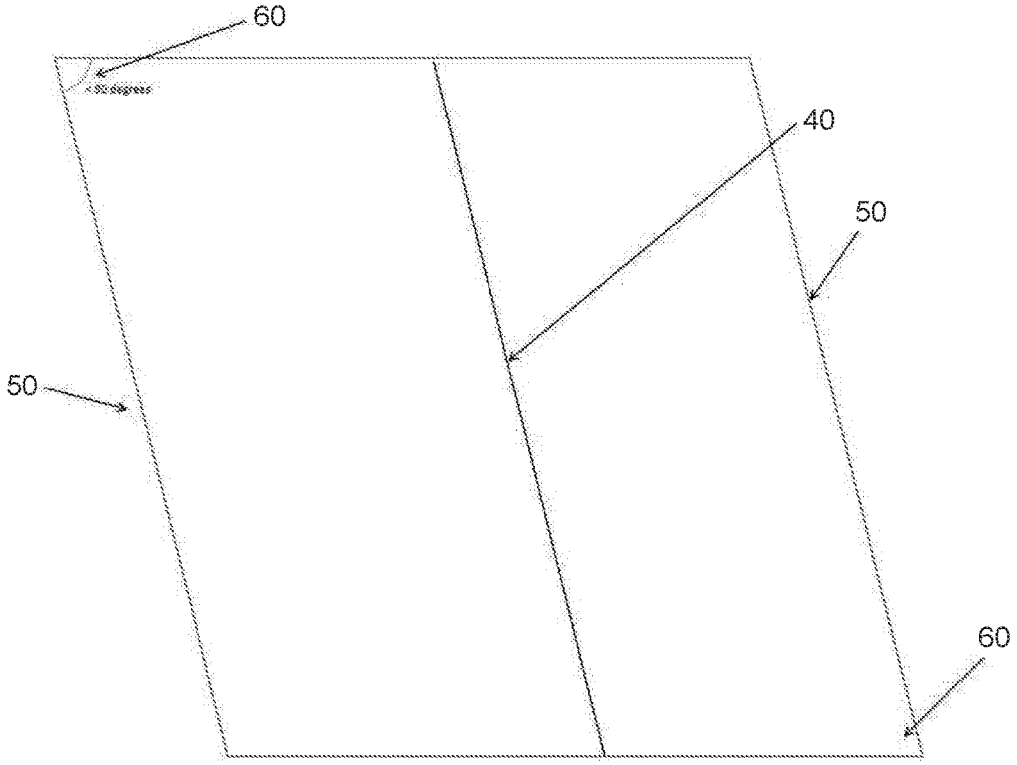
FIG. 2 is a top view of an embodiment of a stain pad.

FIG. 2 is a top view of the embodiment of the applicator shown in FIG. 1 showing an example location of the seam 40 a distance away from the edges/ends 50 along a long side of the applicator as well as the potential relative size of the pre-cut applicator pad. Additionally, FIG. 2 depicts one contemplated shape of pad showing varying degrees of parallelogram. By changing the angle of the top and bottom cuts of the applicator 60 the embodiment can be created as a rectangle or various degrees of parallelogram. By so doing the angle at the opposite corners of the applicator are less than 90 degrees allowing the user to apply stain to deep corners more easily. Although not depicted, other shapes are contemplated such as ovals, circles, squares, cubes and the like.

Figure 3:
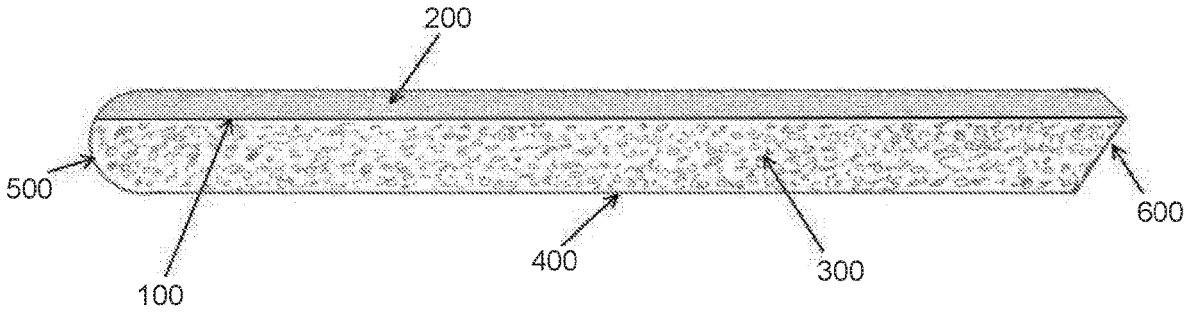
FIG. 3 is a side view of a second embodiment of a stain pad.

FIG. 3 is a side view of a second embodiment of an applicator. In this embodiment, a two-sided applicator is provided. The applicator comprises two separate layers attached along the planar intersection, 100, by way of solvent resistant glue, sonic welding, or other contemplated methods such that, if cut, the two layers, 200 and 300, will remain adhered to one another. In this embodiment the intersection, 100, does not, by way of representation, contain the barrier layer as in FIG. 1, although contemplated in other embodiments. This two-sided embodiment allows for more consistent application pressure, the application stains of various viscosities or to apply stain using one side and wipe it smooth with the other side. The stiffness of the upper layer, 200, more evenly disburses finger pressure into the lower layer, 300, providing more consistent application pressure to the wood. The upper layer, 200, is designed to absorb and store small amounts of stain or less viscous stains and slowly release the stain during application. This reservoir, 200, can also be used to remove excess stain after the initial application. The upper reservoir, 200, is made of similar material to the bottom layer, 300, but is relatively thinner, stiffer, less permeable, and less porous yet still allows for stain to penetrate and be stored. The bottom layer, 300, is a reservoir designed to absorb and temporarily store larger amounts of more viscous stain allowing easier release during application. It is made up of a flexible, solvent resistant, highly permeable, porous, material of consistent thickness and is designed to store larger amounts of stain and release it quickly for efficient application. The third and outer most layer, 400, is the application layer designed to leave a smooth, even layer of stain. It is made of a soft, permeable, loop-less, colorfast, non-shedding, non-fraying material and is attached to the reservoir layers 200 and 300, by way of solvent resistant glue, sonic welding, or other contemplated methods such that, if cut, the outer layer, 400, will remain adhered to the middle layer. In this embodiment, the outer layer 400 is seamed in a location and manner to minimize disruption to the continuous and smooth surface or wiping edges. This embodiment represents, but is not limited to two, contemplated edge designs; a rounded edge, 500, as well as a wedge-shaped edge, 600. Rounded edges are contemplated with various, even lenticular radiuses, and wedge edges are contemplated with varying simple and compound angles and both singular and multi-planar wedge designs.

Figure 4:
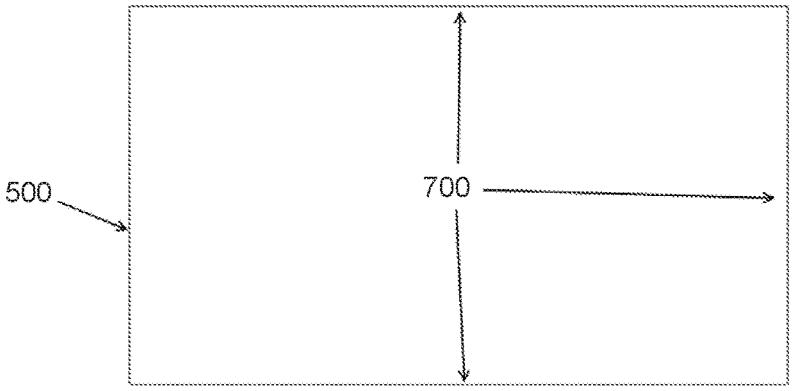
FIG. 4 is a top view of a pre-cut embodiment of a stain pad.

FIG. 4 is a top view of a pre-cut applicator. FIG. 4 depicts one contemplated shape and example relative dimensions of the pad. Although this embodiment depicts a rectangular design, similar to FIG. 2, trapezoidal and other shapes are also contemplated. This pre-cut embodiment does not depict any seams (see FIG. 2, 40) but does show the application edge, 500, as well as the cut edges, 700.

Figure 5:
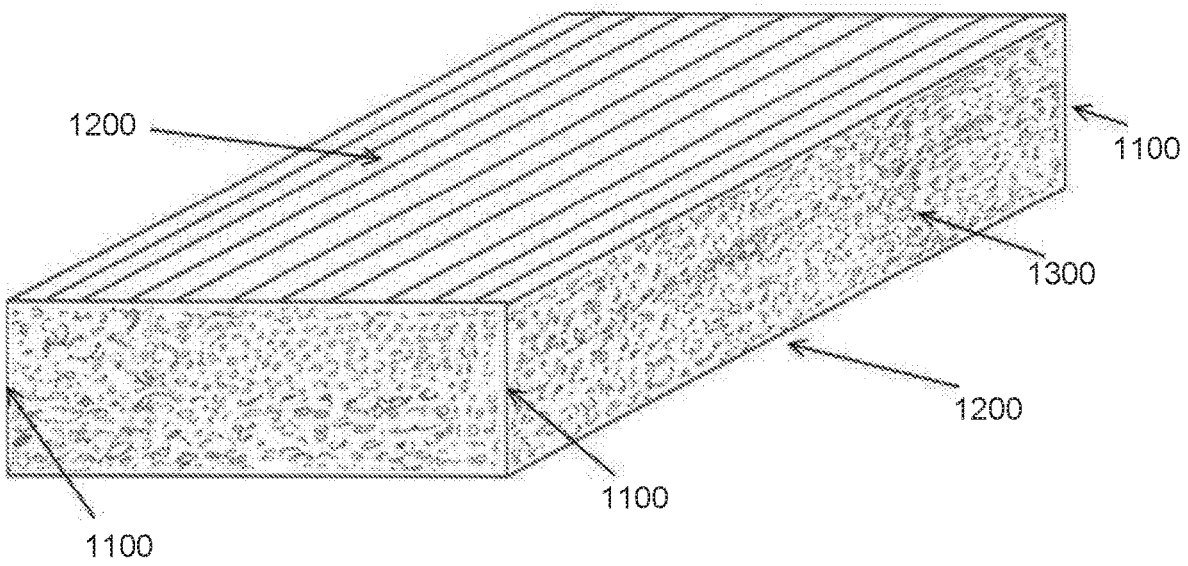
FIG. 5 is a perspective view of the top and two sides of another example embodiment of a pre-cut stain pad.

FIG. 5 is a perspective view of a pre-cut applicator showing the top, and two sides. This embodiment shows relatively thicker applicator with an exposed edge design that is cut, exposing the mid-layer, 1300, on all four sides of the applicator instead of being wrapped by the application layer, 1200 as depicted in FIGS. 1 and 3. In this embodiment there is only one reservoir layer, 1300, but multi-layer embodiments similar to FIGS. 1 and 3 are also contemplated both with and without barrier layers.

The outer most layer, 1200, is the application layer designed to leave a smooth, even layer of stain. It is made of a soft, permeable, loop-less, colorfast, non-shedding, non-fraying material and is attached to the reservoir layers 1300, by way of solvent resistant glue, sonic welding, or other contemplated methods such that, if cut, the outer layer, 1200, will remain adhered to the middle layer. In this embodiment, the outer layer 1200 is continuous all the way to the cut edge. This embodiment represents a 90-degree edge cut, 1100, but other edge designs are contemplated including, but not limited to, concave, convex, internal, and external wedge cuts. Rounded edges are contemplated with various, even lenticular radiuses, and wedge edges are contemplated with varying simple and compound angles and both singular and multi-planar wedge designs.

FIGS. 1-5 show different features of various embodiments of stain applicators for example purposes. These different features may be used in alternative embodiments in which different combinations of features (e.g., a middle, impermeable layer) are provided in the alternative embodiments. For example, a middle, impermeable layer that provides for the ability to use a first side as an applicator side and a second side to wipe stain smooth. The mere placement of particular features in the particular examples is simply meant to explain their construction and relevance without limiting the description to those particular combinations.

Further, throughout the various embodiments, various features may be constructed of materials suitable for their purposes described. In some embodiments, for example, the outer layer may be constructed from polyester or other suitable materials. The middle or inner reservoir layer may be constructed of a foam material such as polyurethane or other suitable materials. An inner impermeable membrane in various embodiments may be constructed of a material such as two sided tape or other suitable impermeable materials and coupled to the middle or other layers such as via adhesive, welding, fusion or the like. Adhesives such as polyurethane and butanone based adhesives may be used to couple various layers together such as the outer layer and the middle or inner reservoir layer or the middle reservoir layer and the inner impermeable layer.

Various embodiments are provided herein. In one embodiment, for example, a wood stain applicator includes an outer application layer attached throughout its surface to at least one permeable, porous middle layer, the a least one porous middle layer attached throughout an at least generally planar surface of the at least one porous middle layer to at least one of the outer application layer and an inner, semi-permeable or impermeable, flexible membrane. The layers can be secured to one another throughout the planar intersection so that the applicator can be cut to any desired size without compromising the adherence of the layers of the applicator.

In one embodiment, for example, the outer application layer is made from a loop-less, colorfast, non-shedding, non-fraying, permeable, solvent resistant material.

In another embodiment, the middle layer comprises a permeable, porous, solvent resistant, open cell material that allows for the temporary storage and release of stain during the application process.

In yet another embodiment, the inner membrane, when included, comprises a relatively thin layer of material. The thin layer in various embodiments, for example, may comprises various pliability and permeability, and resistances to desired solvents.

In another embodiment, each of the layers and all other parts of the applicator are not susceptible to solvents.

In yet another embodiment, each of the layers are attached by way of solvent resistant glue, sonic welding, or other contemplated methods such that the adhesion between the layers is complete and throughout and will not be compromised by solvents or cutting of the applicator.

In another embodiment, the applicator is adapted to be cut to any size without compromising the integrity of the layers.

In yet another embodiment, the outer application layer may be altered in type, material, length and thickness of knap, to create alternate embodiments suitable for application of various stains on various substrates.

In another embodiment, the porous middle layer is adapted to be altered in type, porosity, permeability, density, thickness, to create alternate embodiments suitable for application of various stains on various substrates.

In yet another embodiment, the inner layer is adapted to be altered in its inclusion, permeability, pliability, density, and thickness to create alternate embodiments suitable for various applications.

Although implementations have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims

What is claimed is:

1. A stain applicator comprising:

an inner flexible membrane, the inner flexible membrane comprising a semi-permeable or impermeable flexible membrane;

a permeable, porous reservoir layer having an inner side, an outer side, and a pair of opposing ends, the permeable, porous reservoir layer folded around and secured to the inner flexible membrane along a pair of generally planar opposing surfaces and defining a pair of generally planar intersections between the inner surface of the permeable porous reservoir layer and the inner flexible membrane, wherein the pair of opposing ends define a seam displaced from each of a pair of ends of the stain applicator; and an outer application layer comprising an outer application layer surface and an inner application layer surface, the inner application layer surface secured to the outer side of the permeable, porous reservoir layer along the outer side of the permeable, porous reservoir layer and defining an intersection of the inner application layer surface of the outer application layer and the outer side of the permeable, porous layer;

wherein the inner flexible membrane and the permeable, porous reservoir layer are secured to one another along the pair of generally planar intersections of the inner surface of the permeable, porous reservoir layer and the inner flexible membrane and the intersection of the inner application layer surface of the outer application layer and the outer side of the permeable, porous layer so that the applicator can be cut to any desired size without compromising the adherence of the layers of the stain applicator.

2. The stain applicator of claim 1 wherein the inner flexible membrane separates at least a portion of two opposing sides of the stain applicator.

3. The stain applicator of claim 1 wherein the outer application layer comprises a loop-less, colorfast, non-shedding, non-fraying, permeable, solvent resistant material.

4. The stain applicator of claim 1 wherein the permeable, porous reservoir layer comprises a permeable, porous, solvent resistant, open cell material that allows for the temporary storage and release of stain during the application process.

5. The stain applicator of claim 1 wherein the inner flexible membrane comprises a thin layer of various pliability and permeabilities, and is resistant to solvents.

6. The stain applicator of claim 1 wherein the inner flexible membrane, the permeable, porous reservoir layer and the outer application layer are not susceptible to solvents.

7. The stain applicator of claim 1 wherein the inner flexible membrane, the permeable, porous reservoir layer and the outer application layer are attached by way of solvent resistant glue or sonic welding such that the adhesion between the layers is complete and throughout such as to not be compromised by solvents or cutting of the applicator.

8. The stain applicator of claim 1 wherein outer application layer may be altered in type, material, length and thickness of knap, to create alternate embodiments suitable for application of various stains on various substrates.

9. The stain applicator of claim 1 wherein permeable, porous reservoir layer is adapted to be altered in type, porosity, permeability, density, thickness, to create alternate embodiments suitable for application of various stains on various substrates.

10. The stain applicator of claim 1 wherein an inner flexible membrane is adapted to be altered in its inclusion, permeability, pliability, density, thickness to create alternate embodiments suitable for various applications.

11. The stain applicator of claim 1 wherein an edge of the stain applicator is adapted to be wrapped by the outer application layer, forming concave, convex, internal or external wedge designs.

12. The stain applicator of claim 1 wherein the outer application layer wraps at least substantially wraps around the permeable, porous reservoir layer forming an outer layer over substantially an entire outer surface of the stain applicator.

13. The stain applicator of claim 1 wherein the outer application layer and the permeable, porous reservoir layer each extends generally from a first end of the stain applicator to a second end of the stain applicator.

14. The stain applicator of claim 1 wherein the edge of the stain applicator is adapted to be cut exposing the inner layer.

* * * * *